United States Patent [19]

Snyder

[11] 4,369,633

[45] Jan. 25, 1983

[54] MULTIPLE STAGE COMPRESSOR WITH FLASH GAS INJECTION ASSEMBLY

[76] Inventor: David A. Snyder, 9350 W. Jamaica, Baton Rouge, La. 70815

[21] Appl. No.: 299,215

[22] Filed: Sep. 3, 1981

[51] Int. Cl.[3] ..... F25B 5/00

[52] U.S. Cl. ..... 62/117; 62/510; 417/254; 417/349; 417/374

[58] Field of Search ..... 62/117, 505, 510, 512; 417/254, 349, 373, 503, 901

[56] References Cited

U.S. PATENT DOCUMENTS

| | | | |
|---|---|---|---|
| 880,125 | 2/1908 | Christensen | 417/216 |
| 2,031,237 | 2/1936 | Terry | 62/510 |
| 2,461,760 | 2/1949 | Newton | 62/510 |
| 2,497,450 | 2/1950 | Gygax | 62/510 |
| 2,677,944 | 5/1954 | Ruff | 62/510 |
| 2,719,409 | 10/1955 | Rayburn | 62/514 R |
| 2,992,636 | 7/1961 | Sampietro | 62/510 |
| 3,552,137 | 1/1971 | Christensen et al. | 62/510 |
| 4,173,433 | 11/1979 | Anderson | 417/254 |
| 4,239,460 | 12/1980 | Golz | 417/901 |

OTHER PUBLICATIONS

"Principal of Refrigeration", Second Edition, R. J. Dossat, John Wiley & Sons, Inc., New York, N.Y. 1978, pp. 525–536.

*Primary Examiner*—Ronald C. Capossela

*Attorney, Agent, or Firm*—Lowe, King, Price and Becker

[57] ABSTRACT

A multiple stage compression system, as used in refrigeration apparatus, includes an injection assembly for flash gas resulting from expansion of high-pressure liquid refrigerant. The vapor fraction of the expanded mixture of vapor and liquid is injected by the injection assembly into a compression chamber therefor, and the repressurized vapor fraction mixed with the output of a high pressure compression stage to provide the high-pressure refrigerant. The assembly is removably attached to the compressor, and includes valved passages for the flash gas to and from the compression chamber therefor. The flash gas compression chamber is integrally formed within a piston of the high pressure compression stage for the refrigerant.

25 Claims, 7 Drawing Figures

MULTIPLE STAGE COMPRESSOR WITH FLASH GAS INJECTION ASSEMBLY

BACKGROUND OF THE INVENTION

1. Field of the Invention

This invention relates to compression systems, and more particularly to fluid refrigerant compression systems utilizing multiple compression stages, including means for recycling a fraction of the refrigerant after a first partial expansion thereof.

2. Prior Art

Multiple stage refrigeration compression systems are known in the art. Gygax U.S. Pat. No. 2,497,450, for example, provides a pair of compressing pistons and cylinders, one operating at low pressure and providing compressed gas to a coil, or intercooler, within a condenser, and the other receiving the discharge of the intercooler and providing high pressure gas to the condensing coil. A refrigerant storage tank receives the condensed liquid refrigerant and supplies the same through an intermediate expansion valve to an evaporator. The apparatus does not provide for removal of intermediate pressure gas to achieve savings in energy consumption associated with repeated, unnecessary compression and expansion thereof.

Anderson U.S. Pat. No. 4,173,433 discloses a compressor including a double acting piston to provide two stage operation. In order to avoid unnecessary compression of gas in the piston cavity, vents are provided from the cavity to the low pressure intake. The disclosed compressor provides no structure for utilizing a vapor fraction of partially expanded refrigeration fluid, however, nor is recompression of flash gas considered.

The use of flash gas from an intermediate pressure flash tank in a mixture with discharge from a first stage compressor to provide the input for the second stage compressor is described in "Principles of Refrigeration", Second Edition, R. J. Dossat, John Wiley and Sons, Inc., New York, N.Y. 1978. There is no provision, however, for separately compressing the flash gas prior to mixing with the high pressure refrigerant. See pages 525–536, for example.

A number of references disclose multiple stage compression for refrigeration systems. Terry U.S. Pat. No. 2,031,237 and Newton U.S. Pat. No. 2,461,760 are illustrative of prior art usage of essentially parallel compression stages, rather than sequential compressors.

Rayburn U.S. Pat. No. 2,719,409 discloses a two-refrigerant apparatus including a pair of heat absorbers. Christensen U.S. Pat. No. 880,125 provides an early compound air compressor, including a crank shaft driven piston rod to which are secured two pistons for suction and compression of a gas in two cylinders separated by a valve head/cylinder head.

None of the references provide an apparatus for metering intermediate pressure fluid to a compression chamber therefor and for mixing the output of one of the main compression stages with the repressurized intermediate pressure fluid. The prior art fails to insulate a flash tank from effects of changes in the refrigeration load, exposing the tank to such effects by mixing the gas from a lower pressure stage compressor with the flash gas prior to compression to a higher pressure. Such resulting variation in the flash tank pressure causes changes in the pressure drop across a second-stage expansion valve used in conjunction with the refrigerating evaporator and heat absorbing coil, leading to requirements for increased expansion valve size and thus a reduced degree of control over the flow of refrigerant.

SUMMARY AND OBJECTS OF THE INVENTION

It is accordingly an object of the present invention to overcome the difficulties of the prior art and to provide an improved multiple stage compression system including specific apparatus for injection of flash gas at an intermediate pressure level.

It is another object of the invention to provide a multiple stage compressor in which flash gas, at intermediate pressure, is injected to a separate compression stage therefor, prior to mixing the flash gas with compressed refrigerant.

It is a further object of the invention to provide improved control over refrigerant flow in a refrigeration system by isolation of intermediate pressure flash gas from pressure variations in discharge gas from one of the stages of a multiple stage compressor.

Yet another object of the invention is the provision of an easily removable injection assembly for flash gas from a flash tank to a multi-stage compression system for simplified service and maintenance thereof.

Still another object of the invention is the use of a piston of a multiple stage compressor to form a separate compression chamber for a separate stream of intermediate pressure fluid introduced into the compressor.

It is still another object of the invention to provide a flash gas injection assembly for a multi-stage compressor, the injection assembly forming an integral part of the compressor.

Yet another object of the invention is the provision of a flash gas injection assembly for a multiple stage compressor formed of a pair of cylindrical portions for leading flash gas to and from a compression chamber.

It is another object of the invention to provide an integrated, removable falsh gas injection assembly for a multi-stage compressor and a mixing means for recompressed flash gas and high pressure refrigerant.

A further object of the invention is the provision of an integrated, removable flash gas injection assembly for a multi-stage compressor in which an annular region provides a mixing area for recompressed flash gas and high pressure refrigerant.

It is another object of the invention to provide an injection assembly for a multi-stage compressor and a mixing chamber for recompressed flash gas and high pressure refrigerant, the mixing chamber formed in a cylinder head of one of the stages of the compressor.

In accordance with the foregoing objects of the invention, a multiple-stage compressor is provided for use in a refrigeration system including at least a pair of compression stages for successive compression of a refrigerant. The system includes a pair of expansion valves across which successive pressure drops are provided in the compressed refrigeration fluid. A flash tank separates a portion of the fluid received from the first expansion valve for transmission to a compressor therefor. The remainder of the fluid is passed through the second expansion valve and to a heat absorber, or exchanger. The separated portion of the fluid, after compression by the compressor provided therefor, is mixed with refrigeration fluid which has been compressed at least by one of the compression stages of the multiple-stage compressor.

In accordance with other features of the invention, an injection system for fluid at an intermediate pressure is provided for a multi-stage fluid compression system. The injection system is connected to one of the higher pressure stages of the compressor, and includes an inlet for the intermediate pressure fluid and a compression chamber therefor, separated from the inlet by a valve. A second valve provides for passage of the compressed intermediate pressure fluid from the compressor, and an outlet is provided for the compressed intermediate pressure fluid and for fluid compressed by the higher pressure stage of the compressor to which the injection system is connected.

BRIEF DESCRIPTION OF THE DRAWING

These and other objects, features, and advantages of the invention will become more readily apparent upon reference to the following detailed description of the preferred embodiment in conjunction with the accompanying drawing, in which.

DETAILED DESCRIPTION OF A PREFERRED EMBODIMENT

Figure 1:
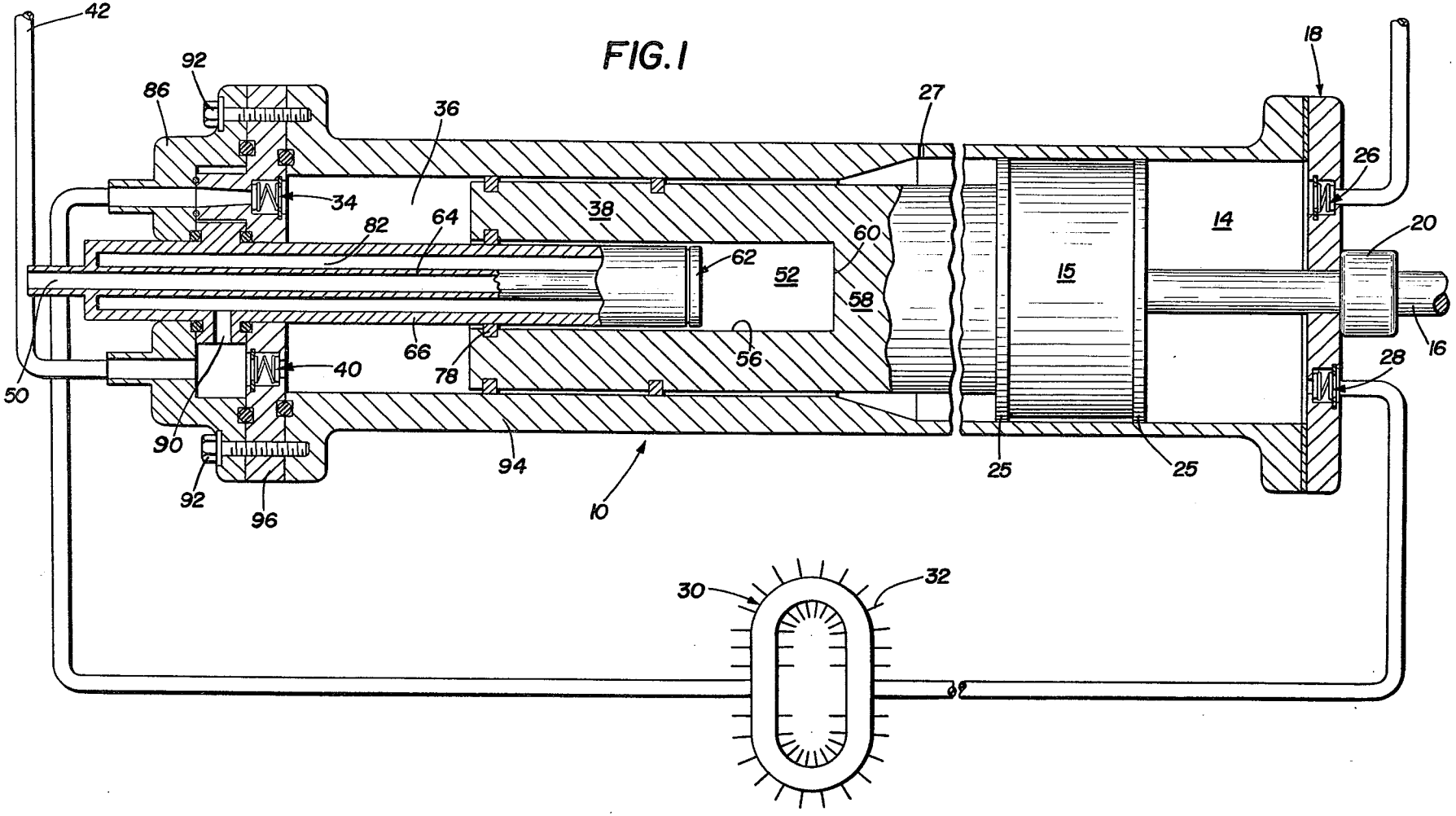
FIG. 1 shows, partly in cross section, a two-stage compressor according to the invention.
Figure 2C:
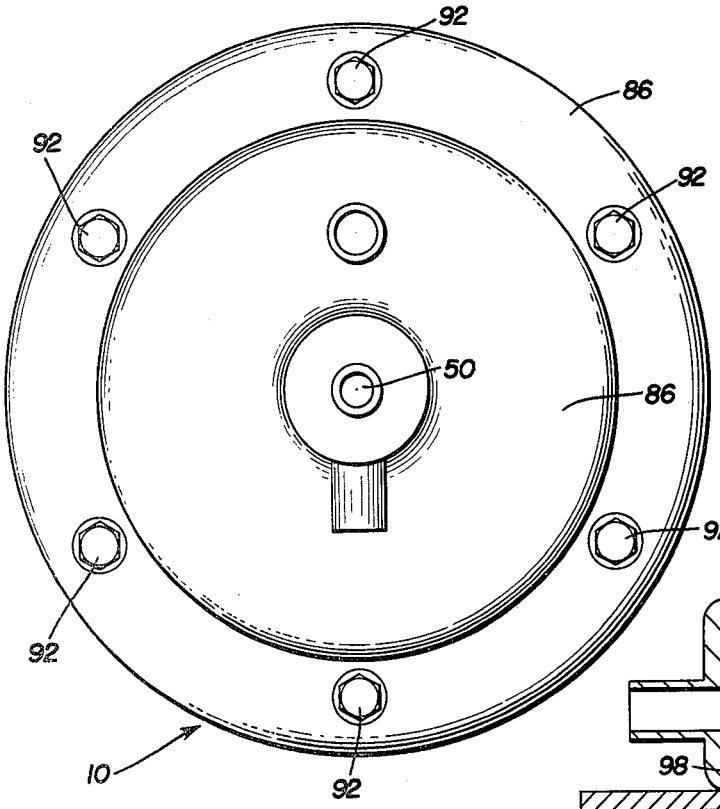
FIG. 2*a, b* and *c* provide detailed view of the high-pressure end of the embodiment of FIG. 1, including a modification thereof shown in FIG. 2*a*, and an end view thereof.
Figure 2A:
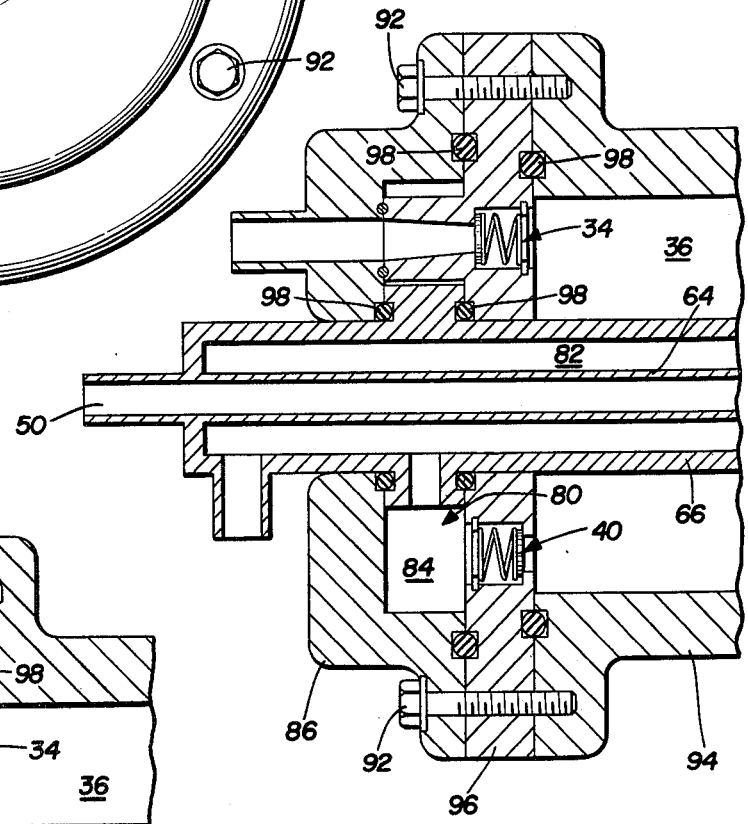
Figure 2B:
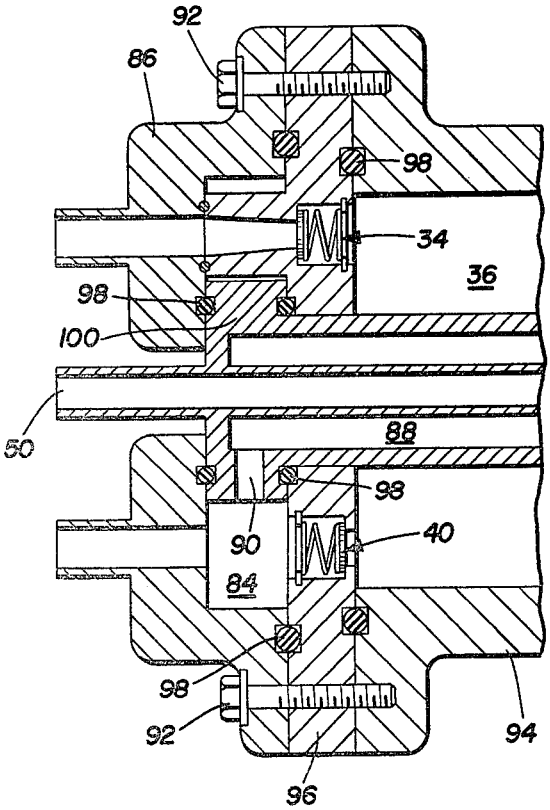

Referring now to FIG. 1, a multiple stage compressor in accordance with the invention is generally shown at 10. For illustrative purposes, the compressor is shown as a two stage compressor, although it is appreciated that 3-, 4-, or 5-stage compressors may similarly use the inventive structure. In fact, any compressor having more than one stage of compression may utilize the present invention to save energy and to provide better control over flow of the compressed fluid.

Figure 4:
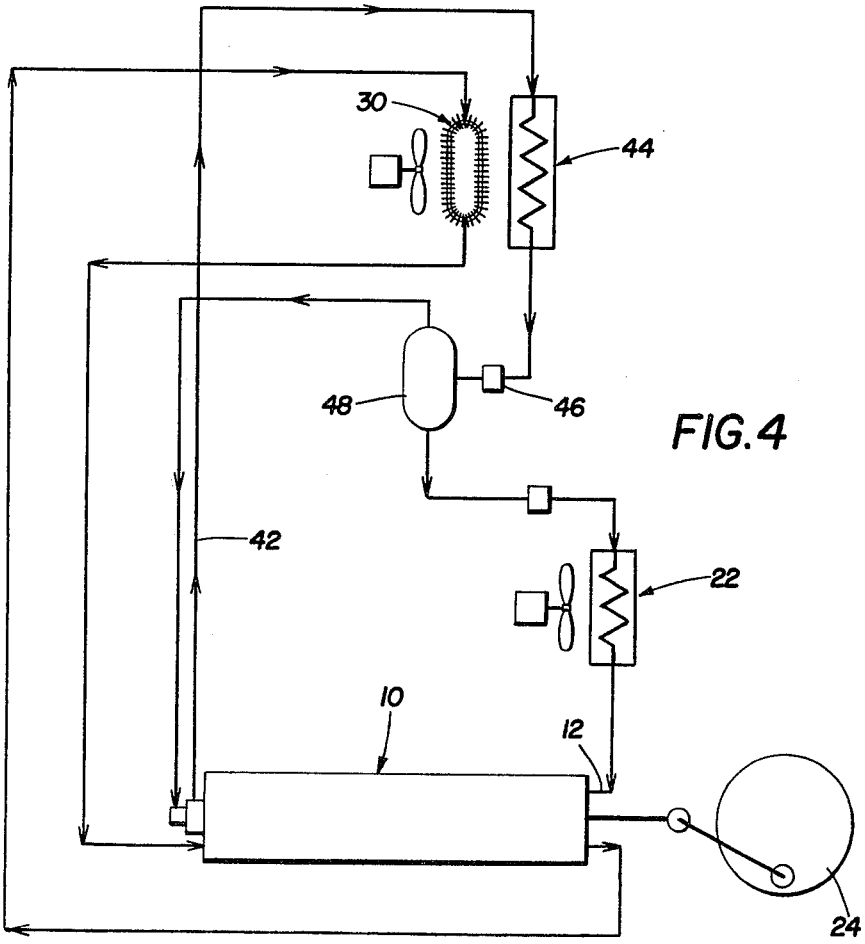
FIG. 4 shows a refrigeration system incorporating a multi-stage compressor according to the invention.

A system utilizing the compressor 10 is exemplified by the refrigeration system of FIG. 4, in which the compressor is shown as receiving low pressure intake fluid at inlet 12 to a first, low pressure compression stage, including a low pressure compression chamber 14, shown in FIG. 1, and a piston 15 therefor. The piston is mounted on a piston rod 16, passing through a cylinder head 18 via a seal 20. In typical refrigeration systems, the low pressure input to the compressor is a gas, or vapor, discharging from an evaporator or heat exchanger 22. The evaporator includes heat absorbing coils for improved heat exchange thereby. Piston rod 16 is driven by a crankshaft drive 24, which may be an electric motor or other drive source. While the drive is shown as including an eccentric driving wheel, it is appreciated that reciprocating lead screws or linear drives may similarly be used. Such drive forms, or any other drive available in the art, do not form part of the present invention. Piston rings 25 are provided for piston 15, and a vent-hole 27 provided in the volume subsequent to the piston, to reduce the load on the crankshaft drive.

Upon movement of the piston 15 in a direction to expand the low pressure chamber 14, low pressure vapor is admitted by a low pressure inlet, or suction valve 26, to the first compression stage. Upon reciprocal movement of the piston in the compression stroke, the gas is expelled from the first stage cylinder and passes through an outlet, or exhaust valve 28 to a surge chamber 30. The higher pressure refrigerant gas output by the first stage is effectively buffered by the surge chamber to compensate for differences in the rates of change of volume of the first stage and the succeeding compression stage. The surge chamber may include optional heat exchanging fins 32 to provide interstage cooling between the first and second stages, decreasing the total amount of compression energy required by the system. When the gas is compressed in compression chamber 14, it is heated adiabatically. Cooling the outlet gas thus reduces the energy required for further compression of the gas in subsequent stages.

From the surge chamber, the raised pressure gas is passed through a second stage suction valve 34 to enter the high pressure compression stage, including a compression chamber 36, or cylinder, and a high pressure piston 38. While pistons 15 and 38 may be separately driven, they are typically mounted on the same piston rod 16. The pistons themselves may be formed as an integrated structure, but for purposes of the present specification are described as separate pistons.

It is thus seen that the exhaust stroke for the first stage becomes the intake stroke for the second compression stage when the pistons therefor are mounted on a common piston rod as shown in FIG. 1. The suction stroke for the first stage is simultaneously the compression, or exhaust stroke for the second stage, at which time the vapor is discharged at a higher pressure than discharged from the first stage. For two stage compressors, this higher pressure is the high pressure level for the vapor. The high pressure gas is discharged through a second stage outlet valve 40.

Referring again to FIG. 4, it is seen that high pressure gas is outlet from the compressor and passes along a conduit 42 to a condenser 44, where the vapor is condensed into a liquid at high pressure. The high pressure liquid is passed through a first expansion valve 46, where the refrigerant is adiabatically expanded to an intermediate pressure, higher than that in evaporator 22. The resulting fluid is a mixture of liquid and vapor. In order to conserve energy, the vapor is separated from the liquid, thus reducing the amount of gas ultimately input to the low pressure stage of the compressor. Thus, rather than further reducing the pressure of the gas across the second expansion valve and in the evaporator only to recompress the same, the energy consumptive process of needless compression, expansion and recompression of the vapor is short-circuited by separating the vapor fraction of the refrigerant at a flash tank 48.

The intermediate pressure vapor is passed to an injection assembly for recompression from the intermediate pressure level to the high pressure level and for mixing with the high pressure output of the second compression stage.

While the present embodiment provides for recompression of the flash gas to the high-pressure output level, it is appreciated that, for multi-stage compressors having more than two stages, the flash gas could be returned to any intermediate stage. In either case, the gas is passed to a special compression chamber therefor, raising its pressure to a predetermined level compatible with (or identical to) the pressure level of one of the output pressure levels of one of the compression stages.

The recompressed flash gas is then mixed with the refrigerant vapor at the appropriate pressure and passed on to the next stage of compression or discharged from the compressor.

The injection assembly according to the present invention includes an inlet 50 for the flash gas. A flash gas compression chamber 52 is formed within the piston 38. While the compression chamber for the intermediate pressure flash gas need not necessarily be within the piston for the stage whose output compressed gas is to be mixed with the flash gas, a location in close proximity to such a stage is clearly advantageous.

Figure 3A:
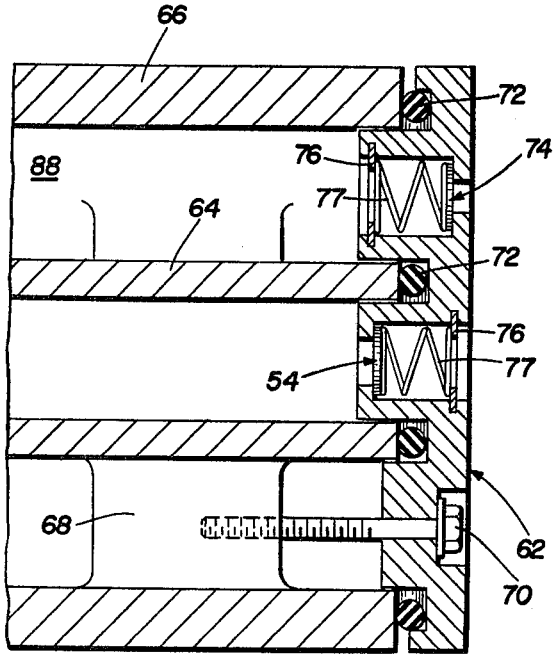
FIG. 3*a* and *b* show a cross-sectional view of the valve end of the inventive injection assembly, and an end view thereof.

The flash gas is injected by an injection valve 54 (FIG. 3A) to the compression chamber 52 during in an intake stroke of the high pressure piston 38. The compression chamber 52 is formed of a recess 56 within piston 38, and a piston 58 utilizing a surface 60 of recess 56 to compress the flash gas against a surface 62 of the injection assembly.

Figure 3B:
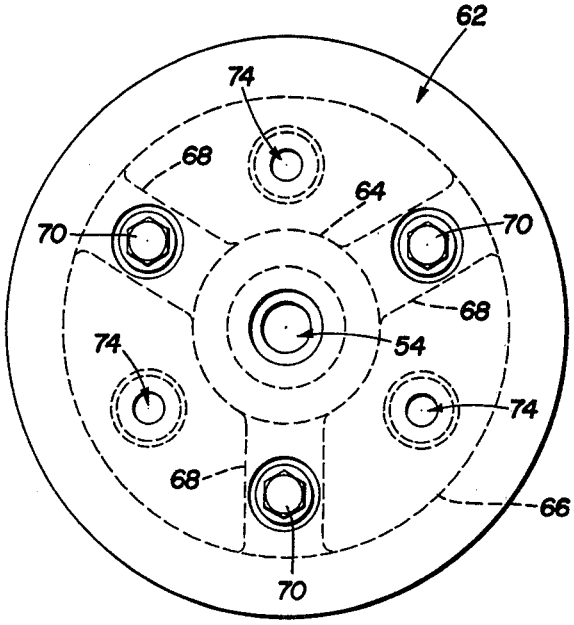

As shown in greater detail in FIG. 3, a valve plate 62 is sealed against the injection assembly, which is formed of two concentric cylinders 64 and 66. Support webs 68 are provided for the two cylinders, and the valve plate is attached to the assembly. Preferably, bolts 70 are used to attach the valve plate to the support webs. The valve plate is sealed against the cylindrical surfaces of the injection assembly by sealing O-rings 72.

Discharge valves 74 are arranged about the valve plate. The discharge and suction valves are preferably formed of sealing material and are urged to their closed positions by biasing springs resting against spring retainers 76. Typically, helical springs may be used, as shown at 77. It is appreciated that other valve configurations may be used for the injection assembly. The flash gas compression chamber is further sealed against the piston 38 by piston rings 78.

During the intake stroke of piston 38, piston 58 similarly creates an intake stroke for the flash gas compression chamber, and intermediate pressure flash gas is drawn in through inlet 50 and suction valve 54 to chamber 52, from flash tank 48. In the compression stroke of piston 38, piston 58 similarly compresses the flash gas in recess 56. As recompressed flash gas is discharged through discharge valves 74, high pressure refrigerant fluid is discharged through outlet valve 40 therefor. Valve 40 may be part of an inlet arrangement 80 to a mixing chamber 82 formed between the coaxial cylinders of the injection assembly as shown in FIG. *2a*. Alternatively, outlet valve 40 may discharge directly to a mixing chamber 84, formed within the cylinder head 86 of the high pressure compression stage shown in FIG. *2b*. In that embodiment, the recompressed flash gas discharged by valves 74 pressurizes annulus 88 and is vented through vent hole 90 to mixing chamber 84, from which the mixed high pressure gas and recompressed flash gas exits to conduit 42. While it is advantageous to utilize the injection assembly or an integral portion of the multi-stage compressor for mixing the two streams of compressed gas, it is within the scope of the invention to utilize an external mixing chamber, by providing separate outlets from the injection assembly and from the high pressure stage of the compressor. Moreover, while the preceding description of the separate compression chambers for the high pressure and flash gases provides for simultaneous compression of both chambers, such is not necessary to practice the invention. Conceivably, the injection assembly may provide input of flash gas to a compression chamber formed in the piston cavity, or in a recess similar to that shown at 56 but in the opposite side of the piston of one of the higher pressure compression stages. Accordingly, while still integral with the compressor and while still providing compression of the flash gas substantially simultaneously with the gas compressed in the higher pressure stage, compression actually occurs on the intake stroke of the piston.

As shown in FIGS. *2a–b*, the injection assembly is retained in the multi-stage compressor by a number of bolts used to attach cylinder head 86 to cylinder 94 forming the higher pressure compression chamber 36. A valve plate 96, containing the suction and outlet valves, 34 and 40, respectively, for the second stage, is sealed against the cylinder and cylinder head by a plurality of O-ring seals 98, which also seal the injection assembly at the valve plate and cylinder head. A flange 100 is provided in the assembly, and tightening of bolts 92 causes the cylinder head to retain the injection assembly flange against valve plate 96. Other attaching means may be used, however, including the possibility of providing a threading for attaching the assembly to the cylinder head, the valve plate, or both. Such non-permanent attachment of the assembly to the compressor enables easy removal thereof for maintenance or repair, subject only to removal of some of the refrigerant lines.

While the invention has been described herein in terms of a compressor for a vapor refrigerant and of expansion valves for a liquid refrigerant, it is similarly applicable to any application in which a fluid is compressed in a plurality of stages, and expanded in a plurality of stages. Such fluids may be liquid, vapor, or mixtures of the two phases. In all such applications, the advantages of the invention accrue from bypassing a part of the expansion and compression process of the fluid, thereby providing a saving in energy requirements and an increase in operating efficiency.

In the refrigeration environment, such energy savings are achieved by removal of the vapor fraction of a fluid, which contributes nothing to the refrigeration effect, from the fluid mixture. Since it is the heat of vaporization of a liquid which is absorbed from the surroundings, thereby refrigerating the same, removal of the vapor fraction of the fluid does not diminish the cooling capacity of the system, while avoiding further reduction in vapor pressure and subsequent compression of the vapor. Inasmuch as a first expansion stage results in vapor refrigerant at an intermediate pressure higher than the pressure of the heat absorption coil, the vapor is removed as flash gas, for separate recompression and subsequent mixing with the high-pressure refrigerant.

In the present invention, compression of the flash gas in the flash gas injection assembly prior to mixing with gas from the first compression stage minimizes the effect of refrigeration load change on flash gas tank pressure. For example, when the refrigeration load on the evaporator falls blow the normal design load, refrigerant flow to the evaporator is decreased. This is typically achieved with a thermostatically activated refrigerant expansion valve which senses the load change by reacting to a temperature decrease at the evaporator outlet. The decreased flow results in a pressure reduction at the inlet to the second compression stage. If the flash gas is exposed to this reduced pressure, as it is if mixed directly with the refrigerant output from the first stage, the pressure reduction is transmitted to the flash tank. Pressure reduction in the flash tank decreases the available pressure drop across the second stage expansion valve. A low available pressure drop requires the use of an oversized expansion valve which may result in unresponsive control.

Separate compression of the flash gas isolates the gas from the first-stage discharge, thus minimizing pressure changes in the flash tank. This acts to keep the pressure drop across the second expansion valve constant, reducing the required expansion valve size and leading to improved control of refrigerant flow. In order to maintain a constant level in the flash tank, flow to the tank is controlled by a flow-controlled first expansion valve, responsive to a float or level sensor in the tank.

In accordance with the preferred embodiment, the flash gas compressor and injection assembly form an integral part of a reciprocating multi-stage compressor rather than a completely separate compressor or a separate piston assembly driven with a shaft common to the primary or secondary compression stages.

While the described embodiment provides for flow of flash gas into the assembly in the inner cylinder and flow of gas outwardly through the annular space, it is understood that the flow directions could be reversed without changing the advantageous results, requiring only minor mechanical changes to achieve such a reversal. Similarly, instead of operating only with an in-line multi-stage compressor in which all pistons are on a common piston rod, the invention may be used with any configuration of a multi-stage compressor, including a V-type configuration wherein a camshaft or a crankshaft drives a plurality of pistons, or a configuration wherein the pistons are separately driven or the cylinders separately formed. It is an advantage of the present invention, however, that whether the compressor is formed of combined cylinders or separate, individual cylinders, the injection assembly does not require a separate compressor, but is integrated with one of the compression stages.

The preceding specification describes, by way of illustration and not of limitation, a preferred embodiment of the invention. It is appreciated that equivalent variations of the invention will occur to those skilled in the art. Such modifications, variations and equivalents are within the scope of the invention as defined with greater particularity in the appended claims, when interpreted to obtain the benefits of all equivalents to which the invention is fairly and legally entitled.

I claim:

1. In a multi-stage fluid compression system having at least a low pressure compression stage and a higher pressure compression stage receiving pressurized fluid from said low pressure stage and providing higher pressure output fluid, the improvement comprising:

an intermediate pressure fluid injection system connected to said higher pressure compression stage, including:

first inlet means for the intermediate pressure fluid;

a first compression chamber for increasing the pressure of the intermediate pressure fluid to a raised pressure level;

first valve means for passage of the intermediate pressure fluid from said first inlet to said first compression chamber therefor;

second valve means for passage of the raised pressure fluid from said first compression chamber; and outlet means for the higher pressure fluid and the raised pressure fluid output by said higher pressure compression stage and by said first compression chamber, respectively.

2. A multi-stage fluid compression system as recited in claim 1 further comprising second inlet means for compressed fluid output by said higher pressure compression stage, and a mixing chamber in communication with said second inlet means for mixing the higher pressure fluid output by said higher pressure compression stage and the raised pressure fluid from said first compression chamber.

3. A multi-stage fluid compression system as recited in claim 2 wherein said mixing chamber is integral with said intermediate pressure fluid injection system.

4. A multi-stage fluid compression system as recited in claim 1 further comprising first compressing means cooperating with said first compression chamber, wherein said higher pressure compression stage includes a second, higher pressure compression chamber and a second compressing means cooperating therewith, and said first and second compressing means are substantially integrally formed for compressing the pressurized fluid and the intermediate pressure fluid is substantially the same operation.

5. A multi-stage fluid compression system as recited in claim 4 wherein said first compression chamber includes a recess formed within said second compressing means, and said first compressing means includes a surface of said recess.

6. A multi-stage fluid compression system as recited in claim 1 further comprising a mixing chamber receiving the raised pressure fluid from said first compression chamber and receiving the compressed higher pressure output fluid from said higher pressure compression stage.

7. A multi-stage fluid compressing system as recited in claim 6 wherein said mixing chamber is integral with a portion of said higher pressure compression stage.

8. A multi-stage fluid compressing system as recited in claim 7 wherein said mixing chamber is integral with a cylinder head of said higher pressure compression stage.

9. A multi-stage fluid compression system as recited in claim 1 wherein said higher pressure compression stage is the final, high pressure compression stage of said multi-stage compression system.

10. A multi-stage fluid compression system as recited in claim 1 wherein said injection system is removably connected to said higher pressure compression stage by attaching means.

11. A multi-stage fluid compression system as recited in claim 10 wherein said attaching means comprises a plurality of bolts attaching a cylinder head and a valve plate to a cylinder forming said higher pressure compression chamber, said cylinder head retaining said injection system against said valve plate.

12. A multi-stage fluid compression system as recited in claim 1 comprising first and second concentric portions, and a valve plate including said first and second valve means joining said concentric portions at one end thereof.

13. A multi-stage fluid compression system as recited in claim 12 further comprising a mixing chamber formed between said concentric portions for receiving the raised pressure fluid from said first compression chamber and receiving the compressed higher pressure output fluid from said higher pressure compression stage.

14. A multi-stage compression system comprising a plurality of compression means, including:

first compression means receiving a refrigeration fluid at low pressure and outputting said fluid at a higher pressure;

second compression means receiving said fluid from said first compression means and outputting said fluid at a high pressure;

first expansion means receiving said high pressure fluid from said second compression means and outputting said fluid at a reduced, intermediate pressure;

flash tank means receiving said fluid from said first expansion means for separating a portion of said intermediate pressure fluid from the remainder thereof;

second expansion means receiving the remainder of said fluid from said flash tank means and outputting said fluid at a lower pressure;

heat absorbing means receiving said fluid at said lower pressure and outputting said fluid at said low pressure to said first compression means; and third compression means receiving said separated portion of said intermediate pressure fluid from said flash tank means and outputting said separated portion at a high pressure for mixing with said refrigeration fluid at least at said higher pressure.

15. A multi-stage fluid compression system as recited in claim 14 further comprising mixing means having first inlet means for receiving said high pressure separated portion of said fluid from said third compression means, second inlet means for receiving high pressure fluid from said compression means, and outlet means for providing a mixture of said high pressure fluid from said second compression means and said high pressure separated portion of said fluid output from said third compression means to said first expansion means.

16. A multi-stage fluid compression system as recited in claim 15 further comprising condensing means for said fluid output from said mixing means, wherein:

said fluid condenses from a vapor phase to a liquid phase;

said flash tank means separates an intermediate pressure vapor portion of said fluid from said remainder;

said remainder comprises a liquid portion of said refrigeration fluid; and said heat absorbing means comprises evaporating means for converting said liquid portion of said remainder to a low pressure vapor for input to said first compression means.

17. A multi-stage fluid compression system as recited in claim 15 wherein said mixing means is integral with one of said plurality of compression means.

18. A multi-stage fluid compression system as recited in claim 15 wherein said mixing means is integral with an injection assembly providing said separated portion of said intermediate pressure fluid to said third compression means.

19. A multi-stage fluid compression system as recited in claim 18 wherein said mixing means includes an annular portion intermediate a pair of cylindrical members included in said injection assembly.

20. A multi-stage fluid compression system as recited in claim 15 wherein said mixing means is integral with a cylinder head portion of one of said plurality of compression means.

21. A multi-stage fluid compression system as recited in claim 14, wherein said third compression means is integral with one of said plurality of compression means.

22. A multi-stage fluid compression system as recited in claims 17 or 21 wherein said one of said plurality of compression means is said second compression means.

23. A multi-stage fluid compression system as recited in claims 14 or 21 further comprising compensating means receiving said higher pressure refrigeration fluid from said first compression means and outputting said higher pressure refrigeration fluid to said second compression means for compensating for different rates of volume change in said first and second compression means.

24. A multi-stage fluid compression system as recited in claim 23 wherein said compensating means comprises heat exchange means for cooling said higher pressure refrigeration fluid.

25. A method for refrigeration comprising the steps of:

compressing a refrigerant first and second times in a multiple-stage compressor;

providing high-pressure refrigerant from said compressor to a condenser;

condensing the refrigerant in said condenser;

expanding the condensed refrigerant a first time through a first expansion valve;

separating flash vapor developed in said first expansion step;

injecting said separated flash vapor to a compression chamber therefor associated with said compressor;

compressing said injected separated flash gas in said compression chamber therefor to a predetermined pressure;

mixing said compressed injected separated flash gas with refrigerant compressed at least once in said multiple-stage compressor;

whereby said high-pressure refrigerant provided from said compressor includes a mixture of compressed flash gas and compressed refrigerant;

expanding the condensed refrigerant a second time through a second expansion valve subsequent to separation of said flash vapor therefrom;

evaporating the twice expanded condensed refrigerant in an evaporator; and supplying the resulting low pressure refrigerant to a low pressure compression stage therefor in said compressor.

* * * * *